US007327344B2

(12) United States Patent
Asada et al.

(10) Patent No.: US 7,327,344 B2
(45) Date of Patent: Feb. 5, 2008

(54) DISPLAY AND METHOD FOR DRIVING THE SAME

(75) Inventors: Tetsuo Asada, Osaka (JP); Osamu Sarai, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 749 days.

(21) Appl. No.: 10/797,108

(22) Filed: Mar. 11, 2004

(65) Prior Publication Data

US 2004/0178981 A1 Sep. 16, 2004

(30) Foreign Application Priority Data

Mar. 14, 2003 (JP) ..... 2003-069261

(51) Int. Cl.
*G09G 3/36* (2006.01)

(52) U.S. Cl. ..... 345/100; 345/98

(58) Field of Classification Search ..... 345/79, 345/96, 98, 100, 209
See application file for complete search history.

(56) References Cited

U.S. PATENT DOCUMENTS 6,320,568 B1 11/2001 Zavracky
6,741,238 B2 * 5/2004 Choi ..... 345/211
7,030,843 B2 * 4/2006 Youn ..... 345/209
2002/0089485 A1 7/2002 Youn

FOREIGN PATENT DOCUMENTS

JP 11-337975 12/1999

* cited by examiner

*Primary Examiner*—Richard Hjerpe
*Assistant Examiner*—Kevin M Nguyen
(74) *Attorney, Agent, or Firm*—McDermott Will & Emery LLP

(57) ABSTRACT

If a display is subjected to n line dot inversion drive control, the polarity pattern of sub-pixels is shifted line by line in a cycle of n frames. Furthermore, in every n horizontal scanning periods in which the polarities of output terminals of a source driver are switched, at least two of the output terminals are short-circuited to carry out electrical charge recovery. By using these methods, it is possible to achieve a reduction in power consumption while improving image quality.

2 Claims, 9 Drawing Sheets

·First Frame

| | | | | | | | | |
|---|---|---|---|---|---|---|---|---|
| 1H | + | − | + | − | + | − | + | − |
| 2H | + | − | + | − | + | − | + | − |
| 3H | − | + | − | + | − | + | − | + |
| 4H | − | + | − | + | − | + | − | + |
| 5H | + | − | + | − | + | − | + | − |
| 6H | + | − | + | − | + | − | + | − |

·Second Frame

| | | | | | | | | |
|---|---|---|---|---|---|---|---|---|
| 1H | − | + | − | + | − | + | − | + |
| 2H | + | − | + | − | + | − | + | − |
| 3H | + | − | + | − | + | − | + | − |
| 4H | − | + | − | + | − | + | − | + |
| 5H | − | + | − | + | − | + | − | + |
| 6H | + | − | + | − | + | − | + | − |

·Third Frame

| | | | | | | | | |
|---|---|---|---|---|---|---|---|---|
| 1H | − | + | − | + | − | + | − | + |
| 2H | − | + | − | + | − | + | − | + |
| 3H | + | − | + | − | + | − | + | − |
| 4H | + | − | + | − | + | − | + | − |
| 5H | − | + | − | + | − | + | − | + |
| 6H | − | + | − | + | − | + | − | + |

·Fourth Frame

| | | | | | | | | |
|---|---|---|---|---|---|---|---|---|
| 1H | + | − | + | − | + | − | + | − |
| 2H | − | + | − | + | − | + | − | + |
| 3H | − | + | − | + | − | + | − | + |
| 4H | + | − | + | − | + | − | + | − |
| 5H | + | − | + | − | + | − | + | − |
| 6H | − | + | − | + | − | + | − | + |

FIG. 7A PRIOR ART

·First Frame

| | | | | | | | | |
|---|---|---|---|---|---|---|---|---|
| 1H | + | − | + | − | + | − | + | − |
| 2H | − | + | − | + | − | + | − | + |
| 3H | + | − | + | − | + | − | + | − |
| 4H | − | + | − | + | − | + | − | + |
| 5H | + | − | + | − | + | − | + | − |
| 6H | − | + | − | + | − | + | − | + |

·Second Frame

| | | | | | | | | |
|---|---|---|---|---|---|---|---|---|
| 1H | − | + | − | + | − | + | − | + |
| 2H | + | − | + | − | + | − | + | − |
| 3H | − | + | − | + | − | + | − | + |
| 4H | + | − | + | − | + | − | + | − |
| 5H | − | + | − | + | − | + | − | + |
| 6H | + | − | + | − | + | − | + | − |

FIG. 7B PRIOR ART

·First Frame

| | | | | | | | | |
|---|---|---|---|---|---|---|---|---|
| 1H | + | − | + | − | + | − | + | − |
| 2H | + | − | + | − | + | − | + | − |
| 3H | − | + | − | + | − | + | − | + |
| 4H | − | + | − | + | − | + | − | + |
| 5H | + | − | + | − | + | − | + | − |
| 6H | + | − | + | − | + | − | + | − |

·Second Frame

| | | | | | | | | |
|---|---|---|---|---|---|---|---|---|
| 1H | − | + | − | + | − | + | − | + |
| 2H | − | + | − | + | − | + | − | + |
| 3H | + | − | + | − | + | − | + | − |
| 4H | + | − | + | − | + | − | + | − |
| 5H | − | + | − | + | − | + | − | + |
| 6H | − | + | − | + | − | + | − | + |

FIG. 7C PRIOR ART

·First Frame

| | | | | | | | | |
|---|---|---|---|---|---|---|---|---|
| 1H | + | − | + | − | + | − | + | − |
| 2H | + | − | + | − | + | − | + | − |
| 3H | − | + | − | + | − | + | − | + |
| 4H | − | + | − | + | − | + | − | + |
| 5H | + | − | + | − | + | − | + | − |
| 6H | + | − | + | − | + | − | + | − |

·Second Frame

| | | | | | | | | |
|---|---|---|---|---|---|---|---|---|
| 1H | − | + | − | + | − | + | − | + |
| 2H | − | + | − | + | − | + | − | + |
| 3H | + | − | + | − | + | − | + | − |
| 4H | + | − | + | − | + | − | + | − |
| 5H | − | + | − | + | − | + | − | + |
| 6H | − | + | − | + | − | + | − | + |

DISPLAY AND METHOD FOR DRIVING THE SAME

BACKGROUND OF THE INVENTION

1. Field of the Invention

The present invention relates to a display that employs a dot inversion drive scheme for a plurality of lines, and a method for driving the display.

2. Prior Art

A liquid crystal display (LCD) is smaller in power consumption than a cathode-ray tube or the like and does not occupy much space, and thus a liquid crystal display is now used as one of principal visual displays. Among them, an active matrix liquid crystal display using TFTs (thin-film transistors) achieves high resolution and is adaptable to a large screen, and therefore, an active matrix liquid crystal display has a wide range of applications such as a personal computer display and a TV screen.

In each of active matrix displays, TFTs are arranged in a matrix pattern on a display panel. The operations of these TFTs are controlled by driver ICs that are normally provided at a frame portion of the display panel. The driver ICs include a source driver and a gate driver, and the operations of these driver ICs are each controlled by a signal outputted from a controller. The controller generates various signals, including a clock signal, so as to carry out appropriate control.

Among the above-described active matrix displays, the current liquid crystal display carries out control called "dot inversion drive" in order to prevent, for example, screen burn-in in liquid crystal.

FIGS. 7A through 7C are diagrams schematically illustrating the control of a liquid crystal display in which a conventional dot inversion drive scheme is employed. FIGS. 8A through 8C are timing charts each showing the waveforms of outputs from output terminals of a source driver and an output control signal in the respective conventional examples shown in FIGS. 7A through 7C. In FIGS. 7A through 7C, the polarities of respective sub-pixels on a display panel are shown for each frame. In each frame shown in the diagrams, the horizontal direction corresponds to the direction in which scanning lines extend in the panel, while the vertical direction corresponds to the direction in which signal lines extend in the panel. "H" shown in the diagrams means a horizontal scanning period, and indicates a scanning line connected to sub-pixels. Herein, an element that includes TFTs and liquid crystal capacitors or light-emitting devices and displays a single dot on the display panel is called a "picture element (or pixel)". Furthermore, sub-elements that constitute a single picture element and display respective colors, e.g., "red (R)", "green (G)" and "blue (B)", in full-color display are each called a "sub-pixel".

FIG. 7A illustrates a so-called "dot matrix inversion control" in which the polarities of the sub-pixels connected to a single signal line are alternately inverted, and are inverted in every 1H cycle (for each row). The polarities of the respective sub-pixels are switched for each frame. The row direction corresponds to the direction in which the scanning lines extend in the respective diagrams of FIG. 7.

In carrying out such control, as shown in FIG. 8A, the polarity of the potential of an output terminal Y (2n−1), located in the (2n−1)-th column of the source driver for supplying voltage to the sub-pixels, is inverted in every 1H cycle, and the waveform of the potential of the output terminal Y (2n−1) is almost uniformly changed when the polarity thereof is positive and is also almost uniformly changed when the polarity thereof is negative. In particular, when the polarity of the output terminal is positive, the ultimate voltage of the output terminal Y (2n−1) is almost the same at the end of one horizontal scanning period, and when the polarity of the output terminal is negative, the ultimate voltage of the output terminal Y (2n−1) is also almost the same at the end of one horizontal scanning period. That is, the ultimate potential of the output terminal is almost the same in each line.

Although the polarity of an output terminal Y (2n) in the 2n-th column adjacent to the output terminal Y (2n−1) is opposite to that of the output terminal Y (2n−1), potential changes of the output terminal Y (2n) are substantially uniform when the polarity thereof is positive and when the polarity thereof is negative.

Therefore, in the dot matrix inversion control shown in this description, screen flicker is suppressed, and thus display quality is improved. Since the liquid crystal display in this description employs a common-inversion drive scheme, a state in which the polarity of an output terminal is "positive" means a state in which the potential of the output terminal exceeds a common voltage, and a state in which the polarity of an output terminal is "negative" means a state in which the potential of the output terminal is below a common voltage.

Besides, two line dot matrix inversion control as shown in FIG. 7B is also carried out. Herein, "n line dot matrix inversion control" signifies the control for changing the polarities of the sub-pixels for n lines in the direction in which the signal lines extend (i.e., the vertical direction in the panel shown in the respective diagrams of FIG. 7). Therefore, the "two line dot matrix inversion control" refers to a method for carrying out control so that the polarities of the sub-pixels in the (2m−1)-th row and the 2m-th row become identical (m is a natural number). Further, in this control method, the polarities of the respective sub-pixels are inverted for each frame.

In the two line dot matrix inversion control described above, the polarities of the respective sub-pixels are switched in every 2H cycle as shown in FIG. 8B, and therefore, power consumption is reduced as compared with the dot matrix inversion control shown in FIG. 7A in which charge and discharge are repeated in every 1H cycle.

However, in this control method, even though power consumption is reduced, the potentials of the output terminals differ for each line, and thus image quality might be degraded.

As shown in FIG. 8B, if the ultimate potential of the output terminal Y (2n−1) at the end of 1H is compared with that of the output terminal Y (2n−1) at the end of 2H, the potential of the output terminal Y (2n−1) at the end of 2H is higher than that of the output terminal Y (2n−1) at the end of 1H. On the other hand, the potential of the output terminal Y (2n) at the end of 2H is lower than that of the output terminal Y (2n) at the end of 1H. This means that, in the same frame, the absolute value of a difference between the output voltage in the second row (i.e., in the second line) and the target voltage is smaller than that of a difference between the output voltage in the first row (i.e., in the first line) and the target voltage, and the brightness of the sub-pixels in the second row is greater than that of the sub-pixels in the first row. Besides, in the next frame, even if the polarities are switched, the absolute value of the target voltage for each output terminal does not change, and therefore, variations occur in brightness of each sub-pixel.

In order to solve the above-described problems, the adjacent output terminals of the source driver are short-circuited for a certain period of time. If the adjacent output terminals are electrically connected, the potentials of both the output terminals are changed so as to be uniformized. This operation for electrically connecting two or more output terminals will be hereinafter called "charge sharing".

In the example shown in FIG. 7C, the charge sharing is carried out for a certain period of time from the start of each horizontal scanning period in the two line dot matrix inversion control similar to that shown in FIG. 7B. As a result, as shown in FIG. 8C, since the potentials of the adjacent output terminals of the source driver are uniformized, potential variations with respect to the target potential are reduced irrespective of the polarity of each output terminal.

Next, an exemplary configuration of a source driver including an electrical charge recovering means for carrying out this charge sharing will be described. The source driver described below is used not only in the two line dot matrix inversion drive scheme, but also in general dot inversion drive schemes.

FIG. 9 is a block diagram illustrating the configuration of a source driver that is generally used in a liquid crystal display, and FIG. 10 is a timing chart showing changes in various control signals during one horizontal scanning period in the source driver.

As shown in FIG. 9, the source driver includes: a gray level data input means 110 for receiving an image data signal and a data capture signal and for outputting gray level data; a first polarity switching means 112 for receiving an output signal from the gray level data input means 110, a polarity switching signal and a clock signal, and for switching the polarity of each output terminal; a positive polarity D-A converter (hereinafter abbreviated as a "positive polarity DAC") 114 for receiving an output from the first polarity switching means 112 and for receiving the supply of a reference voltage; a negative polarity D-A converter (hereinafter abbreviated as a "negative polarity DAC") 116 for receiving an output from the first polarity switching means 112 and for receiving the supply of a reference voltage; a second polarity switching means 118, which is controlled by a polarity switching signal, for outputting an output signal from the positive polarity DAC 114 or an output signal from the negative polarity DAC 116; output terminals Y (2n−1) and Y (2n) connected to operational amplifiers 120*a* and 120*b*, respectively, each of which receives an output from the second polarity switching means 118 and is controlled by an output control signal; and an electrical charge recovering means 122 for electrically connecting the output terminals Y (2n−1) and Y (2n) for a certain period of time. In this source driver, gray level data responsive to image data is transmitted to sub-pixels via the DACs and operational amplifiers, and the polarities of the adjacent output terminals Y (2n−1) and Y (2n) are controlled so as to be opposite to each other by the first and second polarity switching means 112 and 118.

As shown in FIG. 10, in the source driver shown in FIG. 9, when a data capture signal rises to a high level during a horizontal scanning period, the image data signal is captured into the gray level data input means 110. The input of the image data signal is automatically finished at the time when final data A is inputted.

Next, when the output control signal rises to a high level, the polarity of each output terminal is determined, and a path in the source driver is switched in accordance with the polarity of each output terminal determined by the first and second polarity switching means 112 and 118. At this time, the electrical charge recovering means 122 enters an electrical charge recovery period during which the electrical charge recovering means 122 electrically connect the output terminals Y (2n−1) and Y (2n). During the electrical charge recovery period, the potentials of the output terminals Y (2n−1) and Y (2n) become close to each other. The output control signal rises to a high level without exception after the input of the image data signal has been finished.

Then, when the output control signal falls to a low level, the electrical charge recovery period is finished, and the output, responsive to the gray level data captured during the previous horizontal scanning period, is outputted from the output terminals Y (2n−1) and Y (2n).

FIG. 10 shows an example in which the potentials of the output terminals Y (2n−1) and Y (2n) are interchanged. As shown in this example, when the polarity of each output terminal is switched from the last horizontal scanning period, electrical charge rapidly moves from the sub-pixels, which are connected to one terminal, to the sub-pixels, which are connected to the other terminal. Therefore, electric power is efficiently utilized.

By employing the above-described inversion drive scheme, a reduction in power consumption can be achieved.

SUMMARY OF THE INVENTION

In the above-described dot matrix inversion control shown in FIG. 7A, however, power consumption is large, and thus it has been difficult to apply this dot matrix inversion control to a display having a large screen. Also, in the two line dot matrix inversion control shown in FIG. 7B in which recovery of electrical charge is not carried out, power consumption is reduced; however, display quality is undesirably degraded. To the contrary, in the two line dot matrix inversion control shown in FIG. 7C in which recovery of electrical charge is carried out in each horizontal scanning period, display quality is improved; however, a loss in electric power occurs during recovery of electrical charge as described above, and therefore, power consumption cannot be sufficiently reduced.

On the other hand, Japanese Unexamined Patent Publication No. 11-337975 proposes, as shown in FIG. 1 in this publication, a technique for changing the polarities of signal lines for each plurality of signal lines, and for sequentially shifting the boundary of polarity change in the direction in which scanning lines extend, thus suppressing screen flicker during inversion drive.

However, according to this method, although image quality can be improved, it is difficult to reduce power consumption.

The present invention has been made in view of the above-described problems, and its object is to provide a voltage-driven type display that can achieve both of the improvement of image quality and the reduction of power consumption, and a method for driving the display.

An inventive display includes: a display panel provided with scanning lines, signal lines located to intersect the scanning lines, and sub-pixels connected to the signal lines; a source driver, whose output terminals are each connected to an associated one of the signal lines, for driving the sub-pixels; and a controller for supplying a control signal to the source driver, wherein given that n is an integer of two or more, the polarity of an output voltage supplied from each output terminal is switched relative to a common voltage in every n horizontal scanning periods, and the timing of switching of the polarity of the output voltage is shifted by one horizontal scanning period for each frame.

Thus, the polarity pattern of the sub-pixels, driven by the source driver, is shifted line by line for each frame. Therefore, the brightness of one sub-pixel is changed in a cycle of n frames, and the overall brightness is uniformized when the screen is viewed with the naked eye. Consequently, the occurrence of variations in display is suppressed.

In one embodiment, the source driver may have a polarity shift circuit to which a polarity switching signal for controlling the switching of the polarity of the output voltage is inputted, and which outputs the polarity switching signal by shifting the signal by one horizontal scanning period for each frame. In such an embodiment, display quality can be improved even if the controller similar to a conventional one is used.

In another embodiment, the controller may have a source driver signal generating circuit including: an n line inverting circuit for generating a polarity switching signal for controlling the switching of the polarity of the output voltage; and a polarity shift circuit for outputting the polarity switching signal by shifting the signal by one horizontal scanning period for each frame. In such an embodiment, display quality can be improved even if the source driver similar to a conventional one is used.

In still another embodiment, the source driver may further have electrical charge recovering means that is provided between two of the output terminals, and is controlled so as to short-circuit at least the two output terminals for a certain period of time in n horizontal scanning periods. In such an embodiment, by carrying out recovery of electrical charge when the polarity of each output terminal is switched, redistribution of electrical charge is carried out via the electrical charge recovering means. Accordingly, not only display quality can be improved, but also power consumption can be reduced.

An inventive method for driving a display is provided on the assumption that the display includes: a display panel having scanning lines, signal lines located to intersect the scanning lines, and sub-pixels that are connected to the signal lines and arranged in a matrix pattern; and a source driver, whose output terminals are each connected to an associated one of the signal lines, for driving the sub-pixels, and that the display is driven by employing an n line dot inversion drive scheme given that n is an integer of two or more.

The inventive method is characterized by including the steps of: a) supplying, from each output terminal of the source driver, an output voltage whose polarity is switched for every n lines; and b) shifting the timing of switching of the polarity of the output voltage from each output terminal line by line for each frame. Thus, since variations in brightness of one sub-pixel are uniformized when the screen is viewed, display quality can be improved.

In one embodiment, the waveform of the output voltage of each output terminal may be changed in 2n ways for each frame, and may be restored in a cycle of 2n frames. By carrying out this control, variations in brightness of each sub-pixel are also uniformized, and thus display quality can be improved. This control does not have to be carried out together with the step b), but may be carried out independently. Even in such a case, the effect of improving display quality is achieved.

In another embodiment, the source driver may further have electrical charge recovering means provided between two of the output terminals, and given that n horizontal scanning periods are defined as one cycle, the method may further include the step of controlling the electrical charge recovering means so that at least the two output terminals are short-circuited for a certain period of time when the polarities of the two output terminals are both switched. In such an embodiment, it becomes possible to reduce power consumption while maintaining a favorable display quality.

BRIEF DESCRIPTION OF THE DRAWINGS

FIGS. 7A through 7C are diagrams schematically illustrating the control of the liquid crystal display in which a conventional dot inversion drive scheme is employed.

DESCRIPTION OF THE PREFERRED EMBODIMENTS

Hereinafter, a liquid crystal display according to an embodiment of the present invention will be described with reference to the accompanying drawings.

<Embodiment of the Present Invention>

Figures 1, 2:
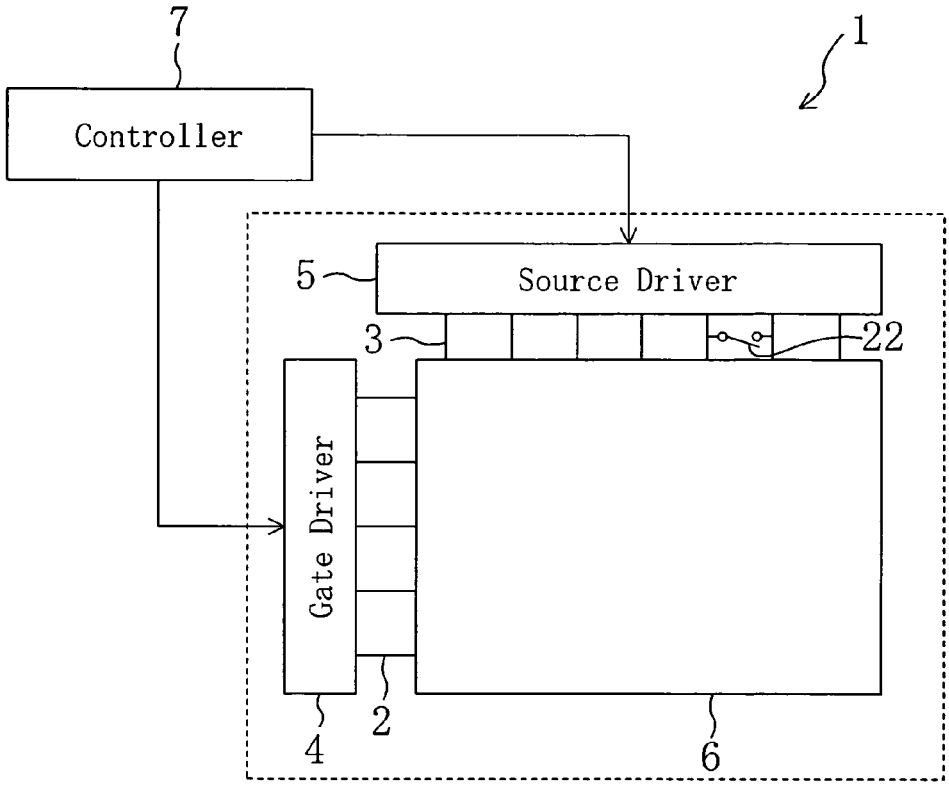
FIG. 1 schematically illustrates a liquid crystal display according to an embodiment of the present invention.
FIG. 2 shows diagrams schematically illustrating an exemplary method for driving the display according to the embodiment of the present invention.

FIG. 1 schematically illustrates a liquid crystal display of the present embodiment.

As shown in FIG. 1, the liquid crystal display 1 of the present embodiment includes: a display panel 6, which is provided with sub-pixels each having a TFT and a liquid crystal capacitor, for displaying images; scanning lines 2 and signal lines 3, which are both provided within the display panel 6, for driving the sub-pixels; a gate driver 4 for supplying voltage to the scanning lines 2; a source driver 5 for supplying voltage to the signal lines 3; and a controller 7 for controlling the operations of the gate driver 4 and the source driver 5. The source driver 5 has an electrical charge recovering means 22 for connecting adjacent output sections for a certain period of time. The signal lines 3 and the scanning lines 2 intersect with each other, and the sub-pixels are arranged in a matrix pattern on the display panel 6.

Normally, the source driver 5 and/or the gate driver 4 are/is integrated on a semiconductor chip; however, in some cases, these driver ICs (i.e., the source driver 5 and the gate driver 4) are formed on the same chip as a power circuit and/or other circuit.

Method for Driving Display

Next, a method for driving the display of the present embodiment will be described. The detailed configurations of the controller 7 and the source driver 5 will be described later.

Figure 3:
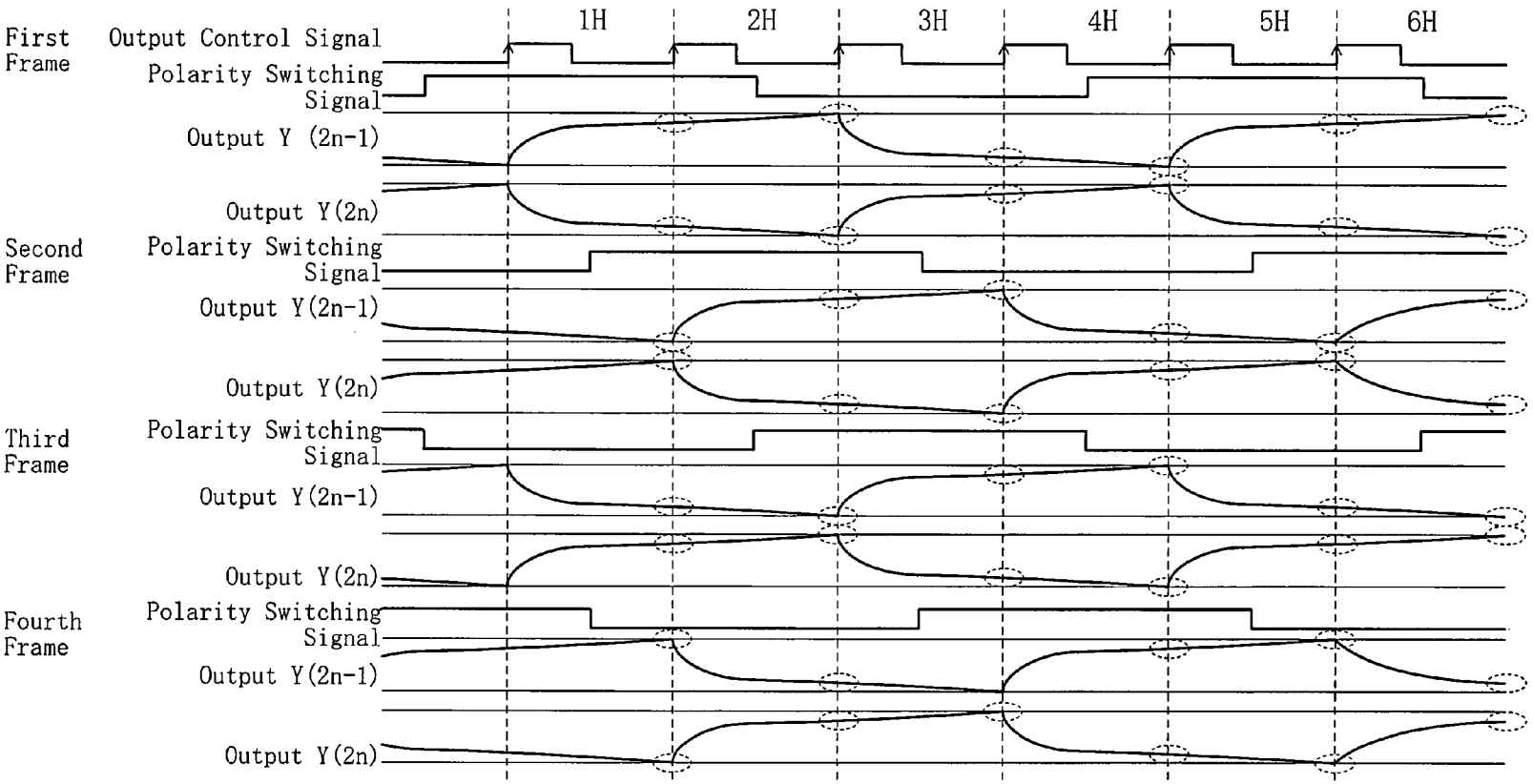
FIG. 3 is a timing chart showing changes in various signals in the method for driving the display according to the embodiment of the present invention.

FIG. 2 shows diagrams schematically illustrating an exemplary method for driving the display according to the present embodiment, and FIG. 3 is a timing chart showing changes in various signals in the method for driving the display according to the present embodiment.

As shown in FIGS. 2 and 3, the driving method for the display of the present embodiment employs two line dot inversion drive scheme. In particular, the driving method of the present embodiment differs from a conventional driving method in that: the polarity pattern of sub-pixels is changed in a cycle of four frames; the sub-pixels having identical polarities are located continuously in two lines in one frame, and the polarities of the sub-pixels are sequentially changed line by line for each frame; and charge sharing by the electrical charge recovering means 22 is carried out once in every two horizontal scanning periods (H).

As shown in FIG. 2, if the two line dot inversion drive scheme is employed in the driving method of the present embodiment, four frames constitute one cycle. Furthermore, the polarities of the sub-pixels are shifted downward line by line for each frame.

In this case, as shown in FIG. 3, the potential of each output terminal of the source driver is changed in polarity in every 2H cycle (two lines). Therefore, in the case of the output terminal Y (2n−1) in the first frame, for example, the polarity is positive from 1H to 2H, and the polarity is negative from 3H to 4H. If the ultimate potential at the end of 1H is compared with the ultimate potential at the end of 2H, a difference between the ultimate potential of the output terminal Y (2n−1) at the end of 2H and the target ultimate potential is smaller than a difference between the ultimate potential of the output terminal Y (2n−1) at the end of 1H and the target ultimate potential. On the other hand, if the ultimate potential at the end of 3H is compared with the ultimate potential at the end of 4H, a difference between the ultimate potential of the output terminal Y (2n−1) at the end of 4H and the target ultimate potential is smaller than a difference between the ultimate potential of the output terminal Y (2n−1) at the end of the 3H and the target ultimate potential. The absolute value of the difference between the potential of the output terminal Y (2n−1) at the end of 1H and the target ultimate potential is equal to that of the difference between the potential of the output terminal Y (2n−1) at the end of 3H and the target ultimate potential, and the absolute value of the difference between the potential of the output terminal Y (2n−1) at the end of 2H and the target ultimate potential is equal to that of the difference between the potential of the output terminal Y (2n−1) at the end of 4H and the target ultimate potential. The brightness of each sub-pixel is determined in accordance with the absolute value of voltage supplied from the source driver. Therefore, in the first frame, the brightness of each sub-pixel connected to the output terminal Y (2n−1) is sequentially "dark", "light", "dark" and "light" from the first line (the first column) to the fourth line. Although the polarity of the output terminal Y (2n) is opposite to that of the output terminal Y (2n−1), the brightness of each sub-pixel connected to the output terminal Y (2n) is "light" and "dark" alternatively for each column in the same way.

To the contrary, the polarity of the output terminal Y (2n−1) in the second frame is shifted from the first frame. In this case, the polarity of the output terminal Y (2n−1) sequentially becomes "negative", "positive", "negative" and "positive" from 1H to 4H. The brightness of each sub-pixel connected to the output terminal Y (2n−1) is sequentially "light", "dark", "light" and "dark" from the first line to the fourth line. That is, if the same sub-pixel is considered, light and dark of the sub-pixel in the second frame are interchanged relative to those of the sub-pixels in the first frame.

Furthermore, light and dark of the sub-pixel in the third frame, and light and dark of the sub-pixel in the fourth frame are interchanged in the same way.

Therefore, according to the driving method for the display of the present embodiment, the polarity pattern of the sub-pixels is shifted in a cycle of four frames. Thus, since the brightness of the respective sub-pixels can be apparently uniformized, image flicker that is visible to the naked eye can be suppressed.

In addition, by shifting the polarity pattern line by line for each frame, "light" and "dark" of one sub-pixel are alternately interchanged, thus enabling further improvement of display quality.

Also, by interchanging light and dark of the sub-pixels for each line in the same frame, the ultimate voltages in all the lines are equalized, thus suppressing screen flicker.

In this manner, according to the driving method for the display of the present embodiment, even if the recovery of electrical charge for the improvement of image quality is not carried out, display flicker can be suppressed. Accordingly, the electrical charge recovery of the electrical charge recovering means 22 can be carried out in order to reduce power consumption. That is, as shown in FIG. 3, the electrical charge recovering means 22 is placed into ON state in every 2H cycle in which the polarity of each output terminal is switched, e.g., at the start of 3H or at the start of 5H in the first frame. Thus, electrical charge accumulated in the panel can be rapidly redistributed, and power consumption can be reduced.

In particular, in the liquid crystal display of the present embodiment, the polarities of the adjacent output terminals of the source driver are always opposite to each other. Accordingly, it is sufficient that the electrical charge recovering means 22 is provided between the output terminals adjacent to each other, and therefore, the liquid crystal display can be implemented using comparatively simple wiring. The output terminals, which are electrically connected by the electrical charge recovering means 22, do not have to be ones that are adjacent to each other. Alternatively, m-th output terminal and (m+3)-th output terminal, for example, may be connected, thus enabling further improvement of the effect of electrical charge recovery. In a full-color liquid crystal display, normally, output terminals for three colors, i.e., "red (R)", "green (G)" and "blue (B)", are repeatedly arranged, and therefore, the terminals for the same color can be connected in every 2H cycle by making the above-described connection. When image is displayed, the gray levels of the adjacent sub-pixels for the same color are often close to each other, and thus the electrical charge recovery can be more efficiently carried out.

Although the exemplary two line dot inversion drive scheme has been described above, if n line dot inversion drive scheme is employed (n is an integer of two or more), screen flicker can be similarly reduced by changing the polarities of the sub-pixels in a cycle of 2n frames. However, the larger the number of the lines, the more conspicuous the variations in ultimate potential become; therefore, two lines are most preferable. Also in the case of n lines, polarity change of each output terminal is preferably shifted line by line for each frame. In that case, the direction, in which the polarity change of each output terminal is shifted, may be changed downward or upward along the vertically extending signal lines. The electrical charge recovery in the case of the n line dot inversion drive scheme may be carried out cyclically when the polarity of each output terminal is switched, and may be carried out once in every n horizontal scanning periods, thus enabling the reduction of power consumption.

As described above, if the driving method for the display according to the present embodiment is used, an improvement in image quality and a reduction in power consumption can be both achieved.

Configuration of Display

Next, the configuration of the display that can be driven by the above-described driving method will be described. The above-described driving method is realized by adding a circuit for shifting polarity to a conventional source driver. The circuit for shifting polarity will be herein called a "polarity shift circuit". The above-described driving method is also realized by controlling the conventional source driver with a controller. Hereinafter, these two examples will be described.

Figure 4A:
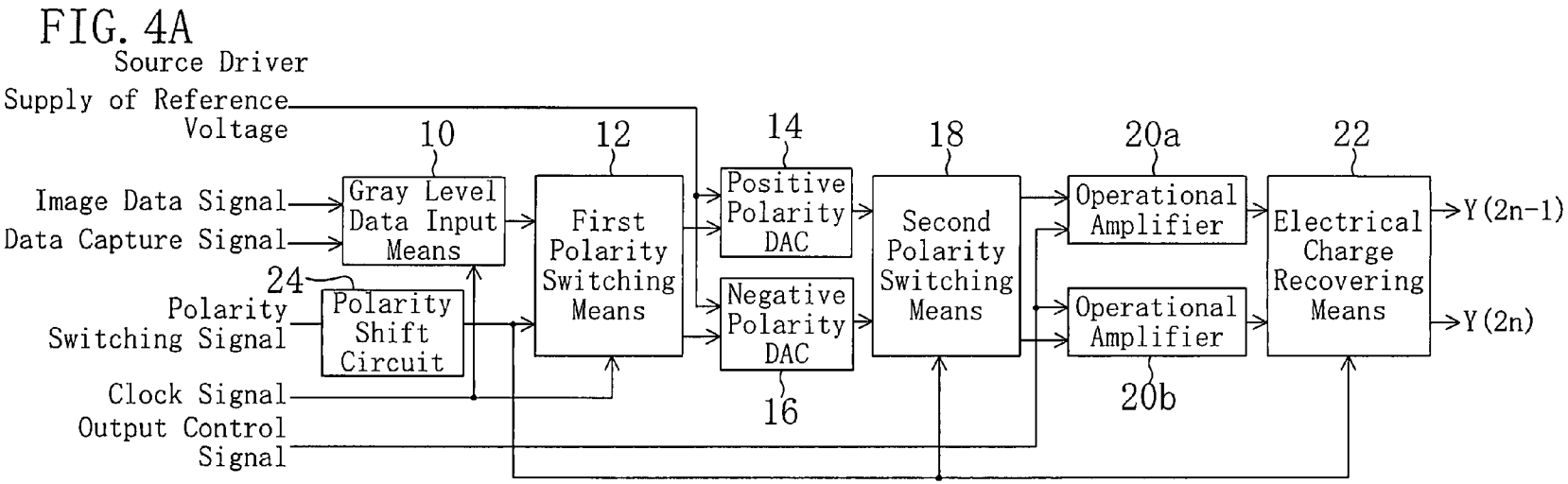
FIG. 4A illustrates an exemplary configuration of a modified source driver in the display according to the embodiment of the present invention.
Figure 4B:
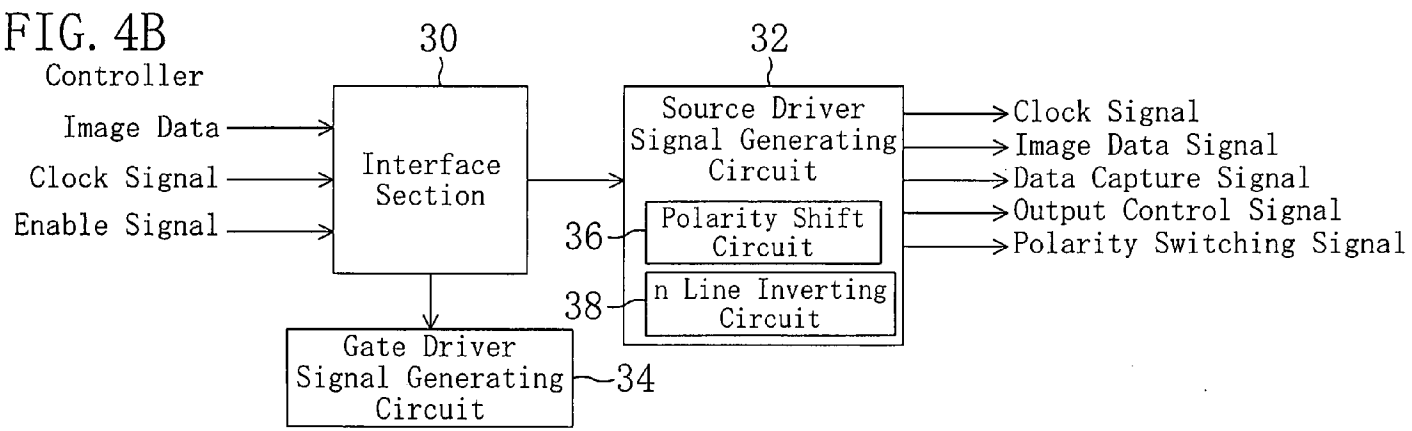
FIG. 4B illustrates an exemplary configuration of a modified controller in the display according to the embodiment of the present invention.

FIG. 4A illustrates an exemplary configuration of a modified source driver in the display of the present embodiment, and FIG. 4B illustrates an exemplary configuration of a modified controller in the display of the present embodiment.

As shown in FIG. 4A, the source driver used in the display of the present embodiment includes: a gray level data input means 10 for receiving an image data signal and a data capture signal and for outputting gray level data; a polarity shift circuit 24 for receiving a polarity switching signal and for converting the polarity switching signal so that the timing of switching of polarity is shifted for each frame; a first polarity switching means 12 for receiving an output signal from the gray level data input means 10, the polarity switching signal from the polarity shift circuit 24 and a clock signal, and for switching the polarity of each output terminal; a positive polarity DAC 14 for receiving an output from the first polarity switching means 12 and for receiving the supply of a reference voltage; a negative polarity DAC 16 for receiving an output from the first polarity switching means 12 and for receiving the supply of a reference voltage; a second polarity switching means 18, which is controlled by the polarity switching signal outputted from the polarity shift circuit 24, for outputting an output signal from the positive polarity DAC 14 or an output signal from the negative polarity DAC 16; the (2n−1)-th operational amplifier 20*a*, which is controlled by an output control signal, for receiving an output from the second polarity switching means 18; the (2n)-th operational amplifier 20*b*, which is controlled by an output control signal, for receiving an output from the second polarity switching means 18; output terminals Y (2n−1) and Y (2n) which are connected to the operational amplifiers 20*a* and 20*b*, respectively; and an electrical charge recovering means 22 for electrically connecting the output terminals Y (2n−1) and Y (2n) for a certain period of time.

In this source driver, gray level data responsive to image data is transmitted to sub-pixels via the DACs and operational amplifiers. If the output signal from the positive polarity DAC 14 is transmitted to the output terminal Y (2n−1), the output signal from the negative polarity DAC 16 is transmitted to the output terminal Y (2n) without exception. On the other hand, if the output signal from the negative polarity DAC 16 is transmitted to the output terminal Y (2n−1), the output signal from the positive polarity DAC 14 is transmitted to the output terminal Y (2n) without exception. That is, the polarity of the output terminal Y (2n−1) and that of the output terminal Y (2n) are controlled so as to be opposite to each other by the first and second polarity switching means 12 and 18.

Furthermore, as shown in the example in FIG. 3, the polarity shift circuit 24 outputs the polarity switching signal, which repeats "high level" and "low level", e.g., in 2H cycle, by shifting the signal by 1H (one line) for each frame. Thus, the driving method for the display of the present embodiment is realized.

Therefore, if the source driver of this type is used, it becomes possible to shift the timing of switching of polarity for each frame even if the controller similar to a conventional one is used. Even if the output terminals Y (2n−1) and Y (2n) are not adjacent to each other, the source driver is configured in the same way.

Next, as shown in FIG. 4B, the driving method of the present embodiment is also realized by modifying the configuration of the controller.

The controller in the display of the present embodiment includes: an interface section 30 to which image data, a clock signal and an enable signal are inputted; a gate driver signal generating circuit 34 for receiving an output from the interface section 30 and for generating a control signal for a gate driver; and a source driver signal generating circuit 32 for receiving an output from the interface section 30 and for supplying, to a source driver, a clock signal, an image data signal, a data capture signal, an output control signal, a polarity switching signal and the like. The source driver signal generating circuit 32 has: an n line inverting circuit 38 for generating, for example, a polarity switching signal for carrying out n line dot inversion control; and a polarity shift circuit 36 for outputting the polarity switching signal by sifting the timing of the polarity switching signal by one horizontal scanning period for each frame. Accordingly, the polarity switching signal outputted from the controller of the present embodiment is a signal that has been shifted by 1H for each frame.

Since the controller of the present embodiment is provided with the polarity shift circuit 36 within the source driver signal generating circuit 32, this controller can be combined with the conventional source driver to enable the realization of the driving method for the display of the present embodiment.

Briefly described below are changes in various signals in the liquid crystal display of the present embodiment which is implemented as described above.

Figure 6:
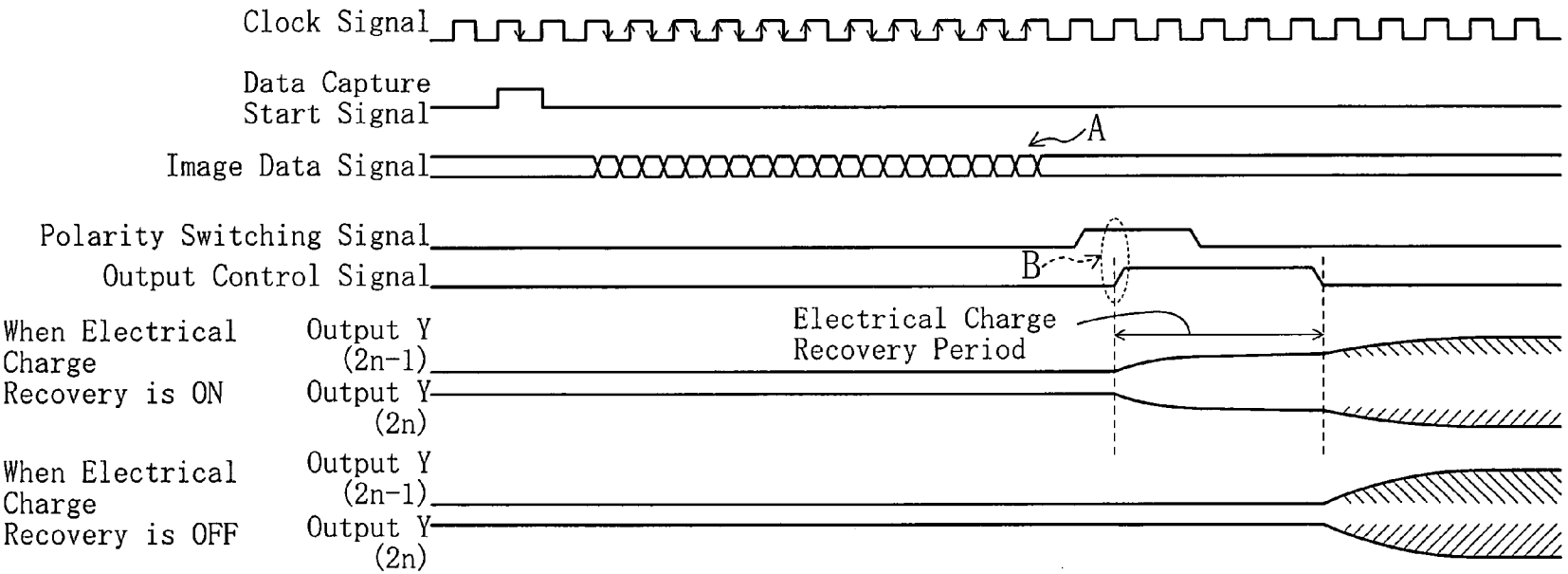
FIG. 6 is a timing chart showing changes in various signals during one horizontal scanning period in the source driver of the liquid crystal display according to the embodiment of the present invention.
Figure 8A:
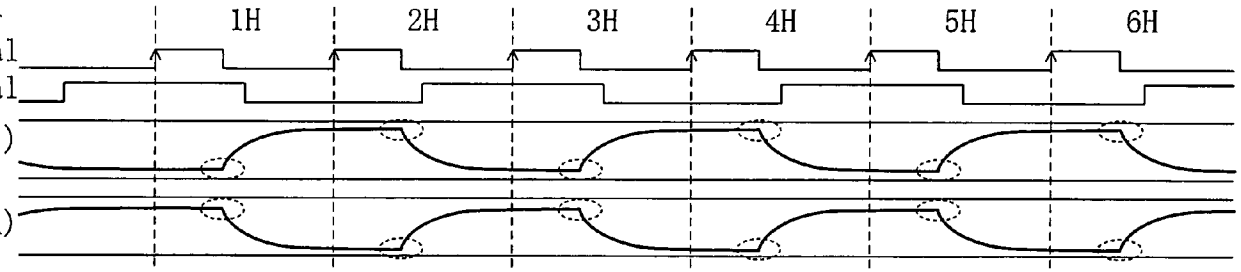
FIG. 8A PRIOR ART
FIGS. 8A through 8C are timing charts each showing the waveforms of outputs from output terminals of a source driver and an output control signal in the respective conventional examples shown in FIG. 7A through 7C.
Figure 8B:
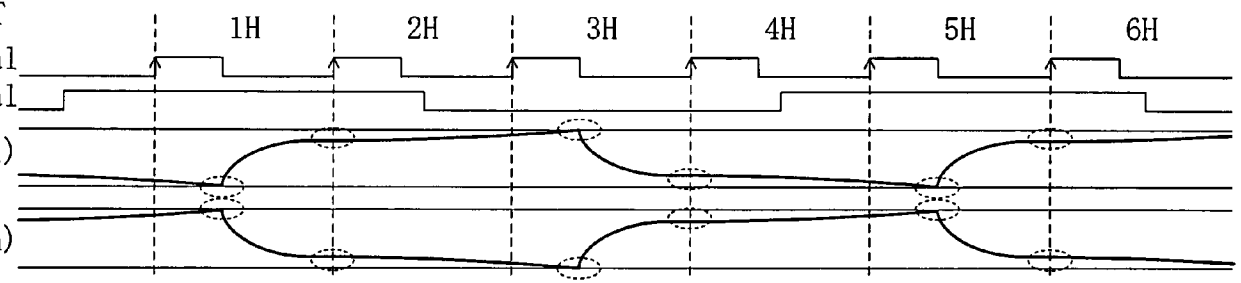
FIG. 8B PRIOR ART
Figure 8C:
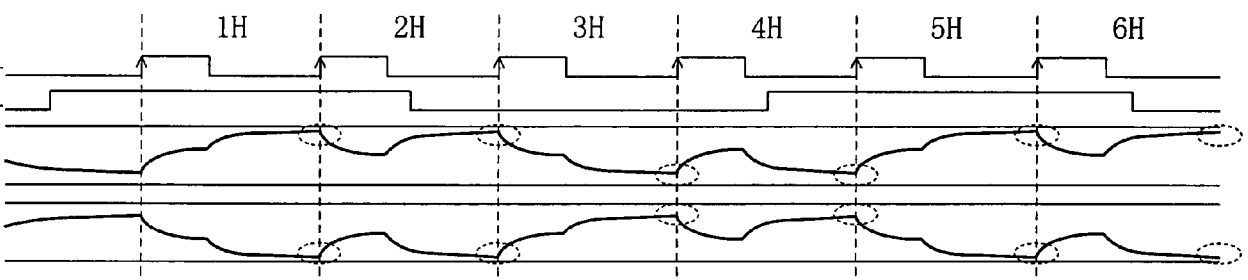
FIG. 8C PRIOR ART
Figure 9:
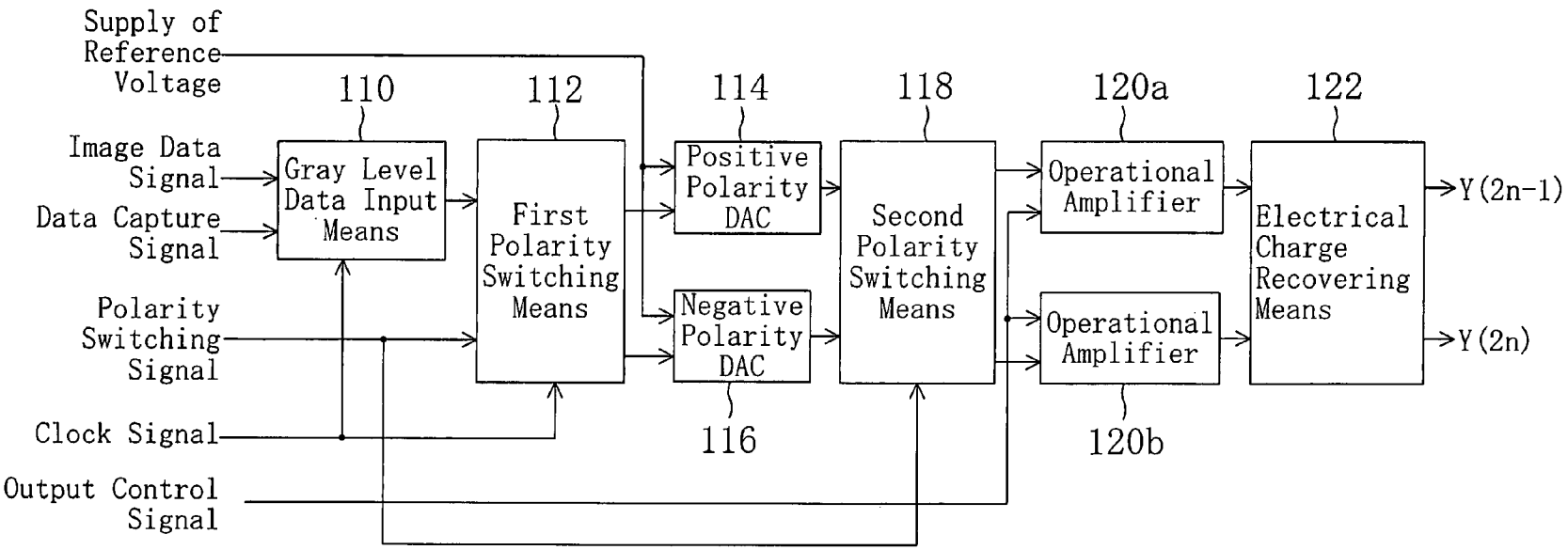
FIG. 9 PRIOR ART
FIG. 9 is a block diagram illustrating the configuration of a source driver that is generally used in a liquid crystal display.
Figure 10:
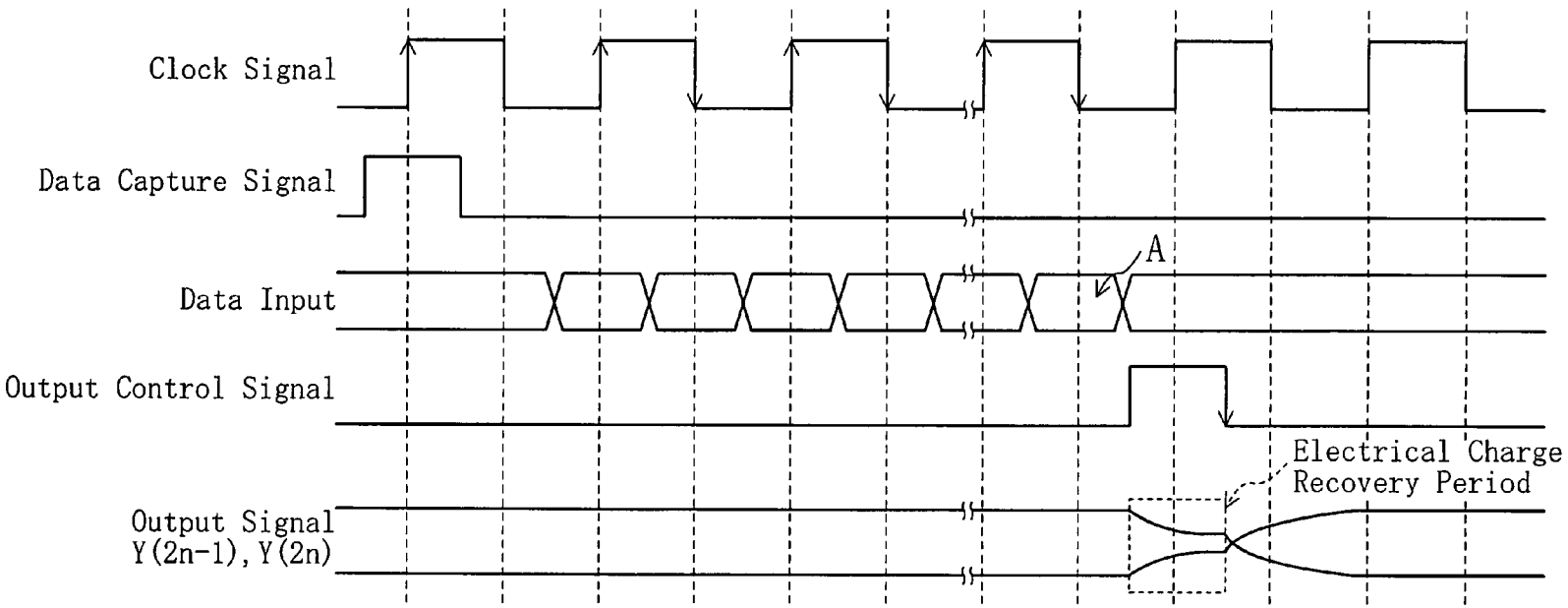
FIG. 10 PRIOR ART
FIG. 10 is a timing chart showing changes in various control signals during one horizontal scanning period in the source driver that is generally used.

FIG. 6 is a timing chart showing changes in various signals during one horizontal scanning period in the source driver of the liquid crystal display of the present embodiment. As shown in FIG. 6, when a data capture start signal rises to a high level and is pulsed after the start of the horizontal scanning period, the input of the image data signal to the gray level data input means is started. During this input, the polarity switching signal is at a low level. Then, at the time when the input of final data A is finished, the input of the image data is automatically finished. At this time, the horizontal scanning period is finished.

Thereafter, if the polarity of an output voltage is switched, the polarity switching signal is changed to a high level or a low level, and the output control signal is changed to a high level or a low level. Thus, the image data that should be inputted to the positive polarity DAC and the image data that should be inputted to the negative polarity DAC are switched. The cycle of the change in the polarity switching signal is 2H cycle similarly to the exemplary polarity switching signal shown in FIG. 3.

Subsequently, during the period over which the polarity switching signal is at a high level, the output control signal rises to a high level, thus allowing the start of an electrical charge recovery period (which is indicated by B shown in FIG. 6). The electrical charge recovery period continues until the output control signal is changed to a low level. Then, upon conclusion of the electrical charge recovery period, the supply of voltage responsive to the inputted image data is started from each output terminal.

Next, the electrical charge recovering means for realizing the driving method of the present embodiment will be described. Hereinafter, three exemplary electrical charge recovering means will be described.

Figure 5A:
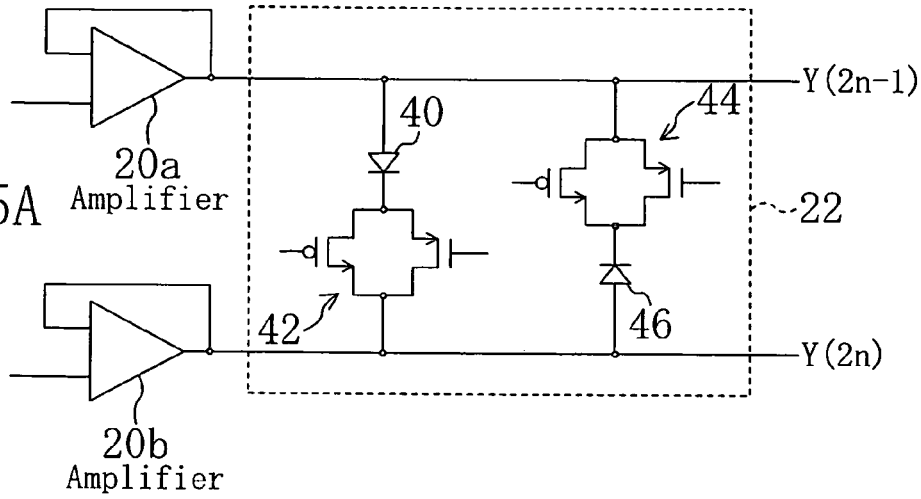
FIG. 5A is a circuit diagram illustrating, in the liquid crystal display according to the embodiment of the present invention, an exemplary electrical charge recovering means in which diodes are used.
Figure 5B:
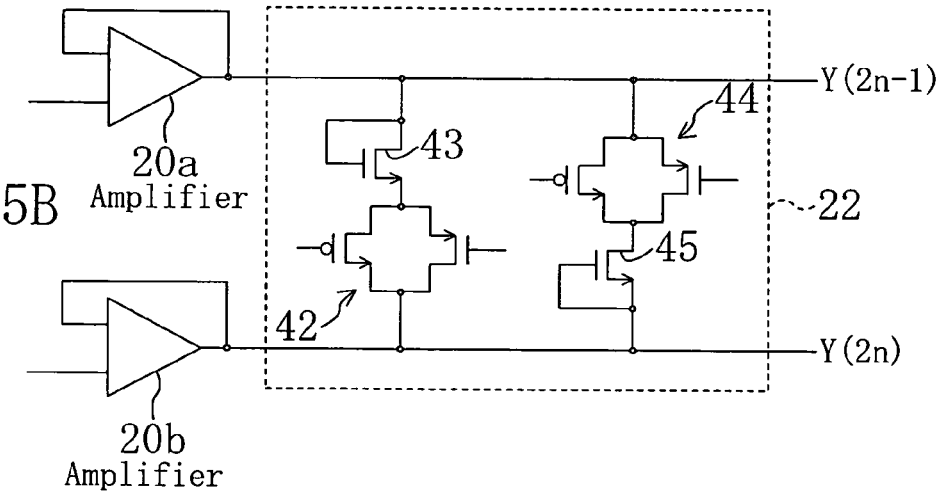
FIG. 5B is a circuit diagram illustrating another exemplary electrical charge recovering means in which transistors and switching circuits are combined.
Figure 5C:
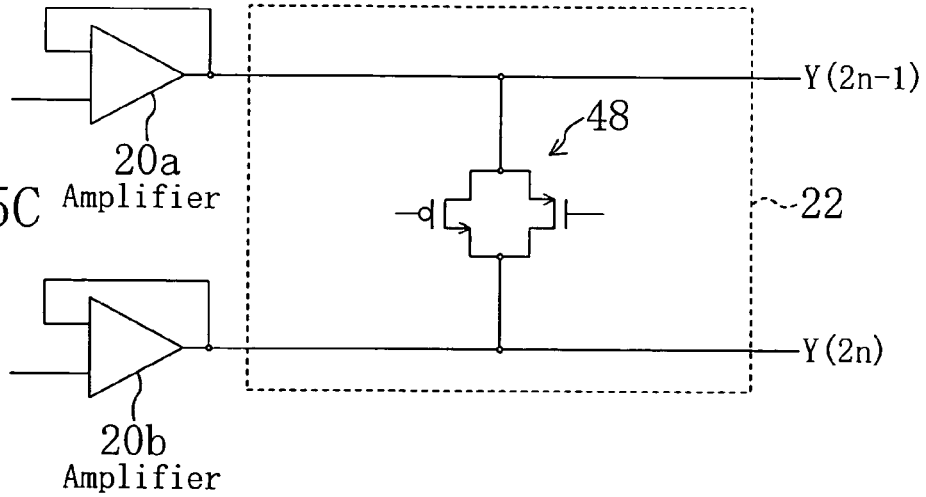
FIG. 5C is a circuit diagram illustrating still another exemplary electrical charge recovering means formed by a switching circuit.

FIG. 5A is a circuit diagram illustrating an exemplary electrical charge recovering means in which diodes are used, FIG. 5B is a circuit diagram illustrating another exemplary electrical charge recovering means in which transistors and switching circuits are combined, and FIG. 5C is a circuit diagram illustrating still another exemplary electrical charge recovering means formed by a switching circuit. In FIG. 5, the output terminals Y (2n−1) and Y (2n) are preferably adjacent to each other or connected to sub-pixels for the same color. However, the output terminals Y (2n−1) and Y (2n) are not limited to such arrangements.

In the example shown in FIG. 5A, the electrical charge recovering means 22 has a first wiring for short circuit and a second wiring for short circuit which are provided between a signal line connected to the output terminal Y (2n−1) and a signal line connected to the output terminal Y (2n). Provided on the first wiring for short circuit are: a switching circuit 42 made up of a pair of a p-channel MOSFET and an n-channel MOSFET; and a diode 40 whose forward direction is from the output terminal Y (2n−1) toward the output terminal Y (2n). On the other hand, provided on the second wiring for short circuit are: a switching circuit 44 made up of a pair of a p-channel MOSFET and an n-channel MOSFET; and a diode 46 whose forward direction is from the output terminal Y (2n) toward the output terminal Y (2n−1).

In this example, among the MOSFETs that constitute the switching circuits 42 and 44, the polarity switching signal, for example, is inputted to the gate of each n-channel MOSFET, and the signal, whose phase is opposite to that of the polarity switching signal, is inputted to the gate of each p-channel MOSFET. In this case, during the period over which the polarity switching signal is at a high level, the switching circuits 42 and 44 are both brought into conduction. During this period, if the potential of the output terminal Y (2n−1) is higher than that of the output terminal Y (2n) by the threshold value of the diode 40, current flows in the forward direction of the diode 40, and thus the output terminals Y (2n−1) and Y (2n) are electrically connected. If the potential of the output terminal Y (2n) is higher than that of the output terminal Y (2n−1) by the threshold value of the diode 46, current flows in the forward direction of the diode 46, and thus the output terminals Y (2n−1) and Y (2n) are electrically connected. If the potential of the output terminal Y (2n−1) is higher than that of the output terminal Y (2n) and the potential difference between both the terminals is below the threshold value of the diode 40, the first wiring for short circuit and the second wiring for short circuit are both brought out of conduction. And if the potential of the output terminal Y (2n−1) is lower than that of the output terminal Y (2n) and the potential difference between both the terminals is below the threshold value of the diode 46, the first wiring for short circuit and the second wiring for short circuit are both brought out of conduction.

Therefore, this configuration of the electrical charge recovering means 22 makes it possible to carry out electrical charge recovery in every 2H cycle and to automatically turn the electrical charge recovering means 22 OFF when the potential difference between the two output terminals becomes lower than a predetermined value.

Next, in another example shown in FIG. 5B, the diodes 40 and 46 in the electrical charge recovering means 22 shown in FIG. 5A are replaced with n-channel MOSFETs 43 and 45, respectively. Also in this electrical charge recovering means 22, similarly to the electrical charge recovering means 22 shown in FIG. 5A, the polarity switching signal is inputted to the gate electrode of each n-channel MOSFET included in the switching circuits 42 and 44.

In this example, the gate electrode of the n-channel MOSFET 43 and that of the n-channel MOSFET 45 are connected to the output terminals Y (2n−1) and Y (2n), respectively. Therefore, if the potential of the output terminal Y (2n−1) is higher than a predetermined value during the period over which the polarity switching signal is at a high level, the n-channel MOSFET 43 is placed into ON state, and thus both the output terminals are electrically connected. If the potential of the output terminal Y (2n) is higher than a predetermined value during the period over which the polarity switching signal is at a high level, the n-channel MOSFET 45 is placed into ON state, and thus both the output terminals are electrically connected.

Next, in still another example shown in FIG. 5C, the electrical charge recovering means 22 is formed by a single transfer gate (switching circuit) 48. In this case, the output control signal and the signal, whose phase is opposite to that of the output control signal, are inputted to the gate electrode of an n-channel MOSFET and that of a p-channel MOSFET which constitute the transfer gate, respectively. Thus, it becomes possible to carry out control so that electrical charge recovery is carried out during the period over which the output control signal is at a high level as shown in FIG. 6.

It should be noted that FIG. 6 shows the potential changes of the output terminals in the case where electrical charge recovery is carried out and in the case where electrical charge recovery is not carried out. From FIG. 6, it can be seen that electrical power (indicated by the oblique lines) required in changing the polarity of each output terminal can be considerably reduced by carrying out electrical charge recovery.

By using the above-described electrical charge recovering means, the liquid crystal display of the present embodiment achieves power savings. It is sufficient that the electrical charge recovering means is configured so as to turn ON only when the polarity of each output terminal is switched in n horizontal scanning periods, and therefore, the electrical charge recovering means is not limited to the configurations shown in FIGS. 5A through 5C.

Furthermore, the electrical charge recovering means may be provided so as to electrically connect all the output terminals whose polarities are switched when electrical charge recovery is carried out.

Instead of the MOSFETs that form a part of the display of the present embodiment, MISFETs, each having a gate insulating film other than a $SiO_2$ film, may be used.

The present application claims priority under 35 USC 119 (a) to Japanese Patent Application No. 2003-69261, the disclosure of which is incorporated herein by reference.

What is claimed is:

1. A display comprising:

a display panel provided with scanning lines, signal lines located to intersect the scanning lines, and sub-pixels connected to the signal lines;

a source driver, whose output terminals are each connected to an associated one of the signal lines, for driving the sub-pixels; and a controller for supplying a control signal to the source driver, wherein given that n is an integer of two or more, the polarity of an output voltage supplied from each output terminal is switched relative to a common voltage in every n horizontal scanning periods, and the timing of switching of the polarity of the output voltage is shifted by one horizontal scanning period for each frame, the source driver has a polarity shift circuit to which a polarity switching signal for controlling the switching of the polarity of the output voltage is inputted, and which outputs the polarity switching signal by shifting the signal by one horizontal scanning period for each frame, and the source driver has electrical charge recovering means which controls such that at least the two output terminals are short-circuited for a certain period of time in n horizontal scanning periods in reaction to the output of the polarity shift circuit.

2. A method for driving a display comprising: a display panel having scanning lines, signal lines located to intersect the scanning lines, and sub-pixels that are connected to the signal lines and arranged in a matrix pattern: and a source driver, whose output terminals are each connected to an associated one of the signal lines, for driving the sub-pixels, the source driver having electrical charge recovering means provided between two of the output terminals, the display being driven by employing an n line dot inversion drive scheme given that n is an interger of two or more, wherein the method comprises the steps of:

a) supplying, from each output terminal of the source driver, an output voltage whose polarity is switched for every n lines;

b) shifting the timing of switching of the polarity of the output voltage from each output terminal line by line for each frame; and c) given that n horizontal scanning periods are defined as one cycle, controlling the electrical charge recovering means, based on the timing of switching of the shifted polarity, so that at least the two output terminals are short-circuited for a certain period of time when the polarities of the two output terminals are both switched.

* * * * *